US006640074B2

(12) United States Patent
Kim

(10) Patent No.: US 6,640,074 B2
(45) Date of Patent: Oct. 28, 2003

(54) DEVELOPING SYSTEM OF LIQUID ELECTROPHOTOGRAPHIC IMAGE FORMING DEVICE

(75) Inventor: Yong-su Kim, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/237,787

(22) Filed: Sep. 10, 2002

(65) Prior Publication Data

US 2003/0129005 A1 Jul. 10, 2003

(30) Foreign Application Priority Data

Jan. 10, 2002 (KR) ..... 2002-1428

(51) Int. Cl.[7] ..... G03G 15/10
(52) U.S. Cl. ..... 399/238; 399/239
(58) Field of Search ..... 399/237, 238, 399/239, 240, 249, 233

(56) References Cited

U.S. PATENT DOCUMENTS 5,255,058 A 10/1993 Pinhas et al.
6,324,367 B1 * 11/2001 Ateya et al. ..... 399/237
6,466,757 B2 * 10/2002 Itaya et al. ..... 399/249

* cited by examiner

*Primary Examiner*—Joan Pendegrass
(74) *Attorney, Agent, or Firm*—Staas & Halsey LLP

(57) ABSTRACT

A developing system of a liquid electrophotographic image forming device includes a developer reservoir in which a developer is stored, a development container in which the developer is supplied from the developer reservoir, a development roller rotating opposite to a photosensitive drum in the development container, and a pumping portion connected between the development container and the developer reservoir via connection pipes. The pumping portion supplies the developer to the development container from the developer reservoir or exhaust the developer from the development container and return the developer to the developer reservoir. Accordingly, the developer supplying and exhausting unit of the developing system can be simplified.

24 Claims, 3 Drawing Sheets

DEVELOPING SYSTEM OF LIQUID ELECTROPHOTOGRAPHIC IMAGE FORMING DEVICE

CROSS-REFERENCE TO RELATED APPLICATIONS

This application claims the benefit of Korean Patent Application No. 2002-1428, filed Jan. 10, 2002, in the Korean Industrial Property office, the disclosure of which is incorporated herein by reference.

BACKGROUND OF THE INVENTION

1. Field of the Invention

The present invention relates to a developing system of a liquid electrophotographic image forming device, and more particularly, to a developing system of a high-concentration liquid electrophotographic image forming device having a developer supplying unit, a developer exhausting unit, and a developer collecting unit.

2. Description of the Related Art

In general, a developing system of a liquid electrophotographic image forming device forms an electrostatic latent image corresponding to a desired image by scanning light on a photosensitive medium, develops the electrostatic latent image using a developer in which powder-shaped toner is mixed with a liquid solvent, and prints the developed image on paper.

FIG. 1 is an example of a conventional developing system of a liquid electrophotographic image forming device disclosed in U.S. Pat. No. 5,255,058.

Referring to FIG. 1, the conventional developing system of the liquid electrophotographic image forming device includes a photoconductive drum 10 charged with a predetermined voltage by a photoconductor charging apparatus 14, an imaging apparatus 16 (laser scanning unit) forming an electrostatic latent image of a desired image by scanning light on the charged photoconductive drum 10 and creating a relative voltage difference representing the electrostatic image, a developer supplying unit developing the electrostatic latent image by supplying a developer to the photoconductive drum 10, and an intermediate transfer member 30 transferring the developed image of the photoconductive drum 10 and printing the transferred image onto paper 72.

The developer supplying unit prepares the developer having a concentration of less than 3% solid particles and supplies the developer between the photoconductive drum 10 and a development roller 38. For this purpose, the developer supplying unit includes concentration cartridges 82 and 84 containing a concentrated developer with a toner concentration of 25% solid, respectively, a solvent cartridge 86 containing a pure solvent, toner reservoirs 55, 57, 59, and 61 mixing the concentrated developer received from the concentration cartridges 82 and 84 with the solvent received from the solvent cartridge 86 and preparing the developer with a uniform concentration of about 2–3% solid particles, a multicolor liquid developer spray assembly 20 pumping the developer prepared in the toner reservoirs 55, 57, 59, and 61 to pumps 90, 92, 94, and 96, respectively, and supplying the developer to the development roller 38, and a collecting unit collecting an excess developer left on the photoconductive drum 10 after the electrostatic latent image is developed.

In addition, the collecting unit includes a collection container 50 collecting the developer supplied between the development roller 38 and the photoconductive drum 10 and returning the collected developer to the toner reservoirs 55, 57, 59, and 61 for each color, a squeeze roller 26 pressing the developer against the photoconductive drum 10 on which the image is developed to squeeze the solvent out of the developer contained in the developed image, and a separator 66 collecting the squeezed developer through the collection container 50, separating respective color toner from the collection container 50, and returning the solvent to a solvent reservoir 65.

In the above structure, in order to perform a development operation, the developer having four colors, such as yellow (Y), magenta (M), cyan (C), and black (K), with the concentration of about 2–3% solid particles, is provided in the toner reservoirs 55, 57, 59, and 61. In order to prepare a developer for each color, the developer supplying unit fabricates a developer with a corresponding concentration by supplying the concentrated developer from the concentration cartridges 82 and 84 and the pure solvent from the solvent cartridge 86 to the toner reservoirs 55, 57, 59, and 61, respectively. For this purpose, each of the toner reservoirs 55, 57, 59, and 61 measures the concentration of the developer containing the solvent according to a concentration sensor (not shown).

Likewise, when the developer is prepared, the development operation starts. First, the photoconductor charging apparatus 14 charges the photoconductive drum 10 with the predetermined voltage. In this state, the imaging apparatus 16 scans light on the charged photoconductive drum 10 to form the electrostatic latent image of the desired image. Subsequently, the pumps 90, 92, 94, and 96 operate such that the developer provided in the toner reservoirs 55, 57, 59, and 61 is supplied between the development roller 38 and the photoconductive drum 10 through the multicolor liquid developer spray assembly 20, thereby developing the electrostatic latent image. These charge, exposure, and development operations of four colors, such as yellow (Y), magenta (M), cyan (C), and black (K), are repeatedly and sequentially performed, and thus the developed image for each color is overlapped on the intermediate transfer member 30. The overlapped color image is printed onto the paper 72 passing through a space between the intermediate transfer member 30 and an impression roller 71.

However, since a high-concentration developer containing more than 3% solid particles cannot be directly used in the development operation, and a low-concentration developer less than 3% solid is used in the development operation, a structure of the system performing the operations from preparing the developer to supplying and collecting the developer is considerably complicated. Thus, in order to solve the problem, a new developing system of a liquid electrophotographic image forming device is required.

SUMMARY OF THE INVENTION

To solve the above and other problems, it is an object of the present invention to provide a developing system of a high-concentration liquid electrophotographic image forming device having a developer supplying unit, a developer exhausting unit, and a developer collecting unit.

Additional objects and advantageous of the invention will be set forth in part in the description which follows and, in part, will be obvious from the description, or may be learned by practice of the invention.

Accordingly, to achieve the above and other objects, there is provided a developing system of a liquid electrophotographic image forming device. The developing system includes a developer reservoir in which a developer is stored, a development container to which the developer is supplied from the developer reservoir, a development roller rotating opposite to a photosensitive drum in the development container, and a pumping portion connected between the development container and the developer reservoir via connection pipes to supply the developer to the development container from the developer reservoir, or to exhaust the developer from the development container and return the developer to the developer reservoir.

It is possible that a developer inlet/outlet is formed on a lower portion of the development container and connected to the pumping portion via the connection pipe, and the pumping portion is a tubing pump selectively supplying and exhausting the developer according to a rotational direction of a rotor installed in the pumping portion.

The system may further include a developer collecting unit collecting the developer exceeding a predetermined level in the development container and returning the developer to the developer reservoir.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
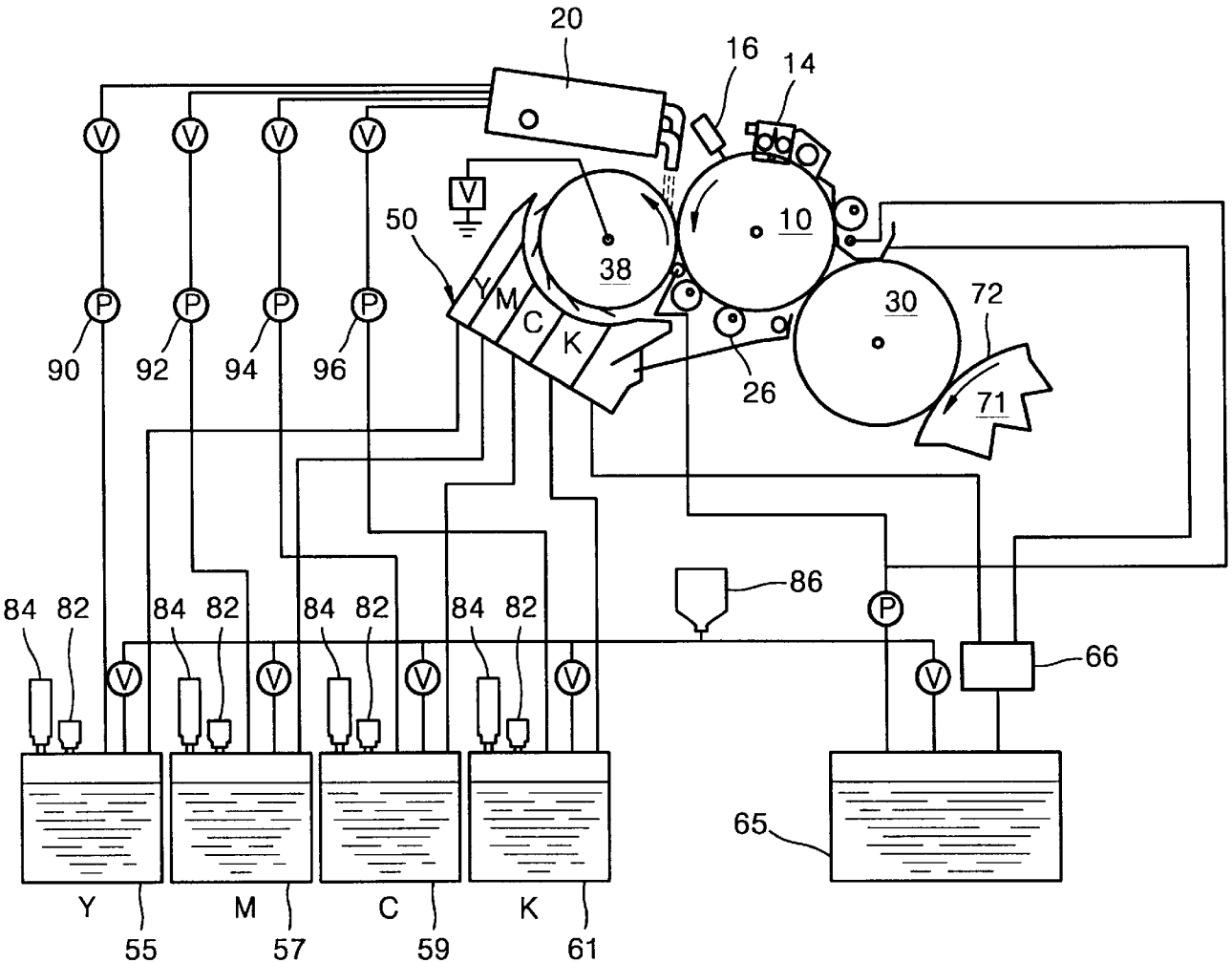
FIG. 1 (PRIOR ART)
FIG. 1 illustrates a conventional developing system of a liquid electrophotographic image forming device.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

The preferred embodiment of the present invention will be described more fully hereinafter with reference to the accompanying drawings.

Figure 2:
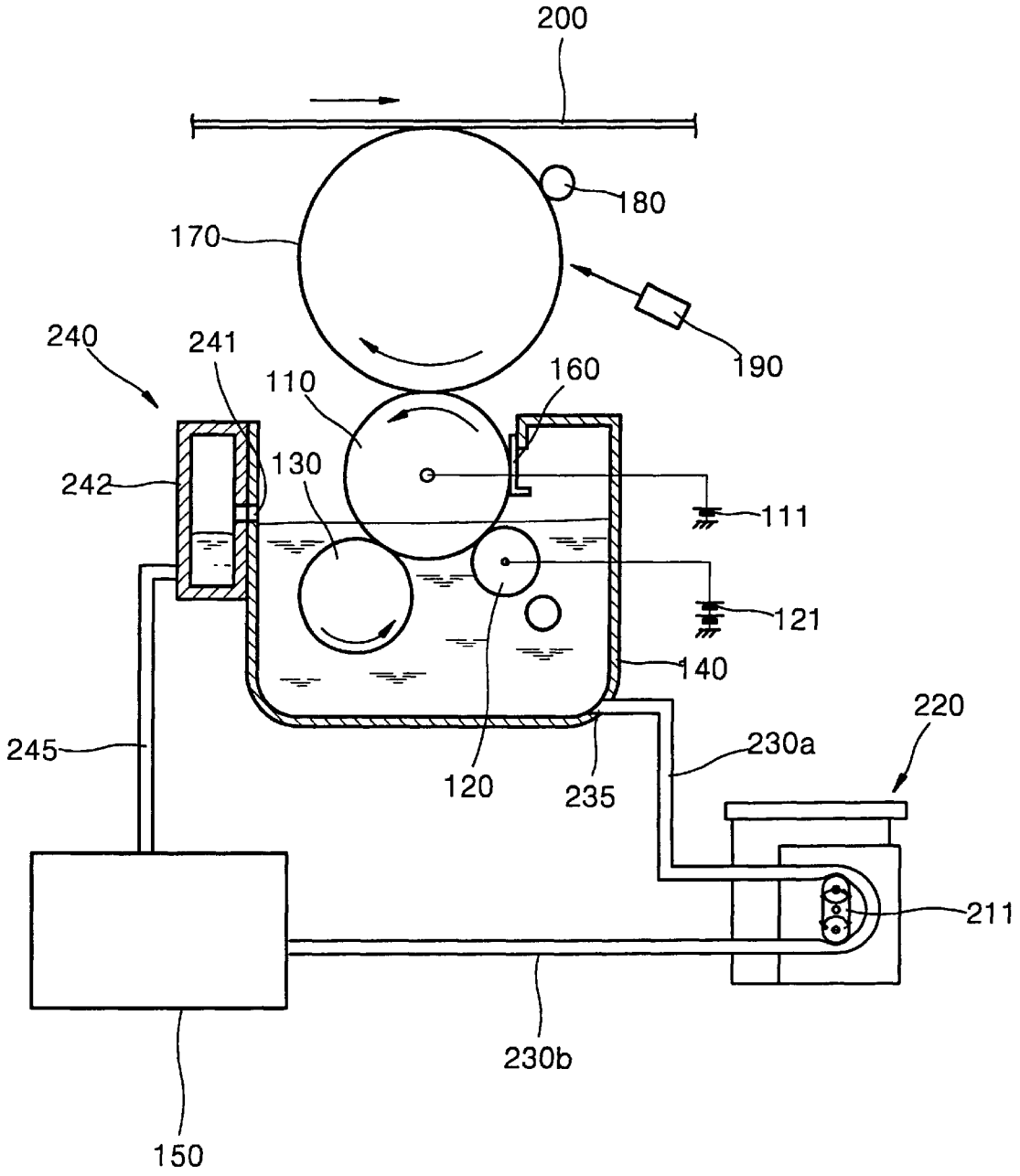
FIG. 2 illustrates a developing system of a liquid electrophotographic image forming device according to an embodiment of the present invention.
Figure 3:
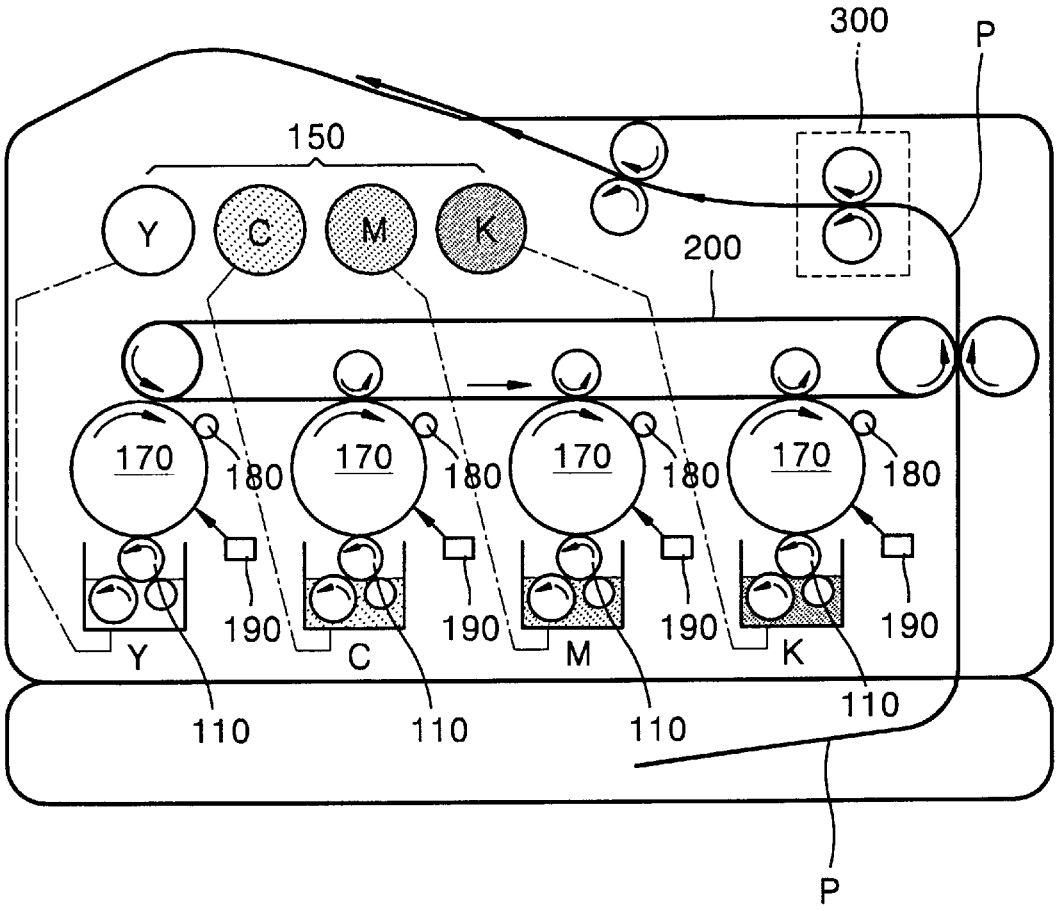
FIG. 3 schematically illustrates a structure of the liquid electrophotographic image forming device having the developing system of FIG. 2.

FIG. 2 illustrates a developing system of a liquid electrophotographic image forming device according to an embodiment of the present invention, and FIG. 3 schematically illustrates a structure of the liquid electrophotographic image forming device having the developing system of FIG. 2.

Referring to FIGS. 2 and 3, the developing system of the liquid electrophotographic image forming device includes a developer reservoir 150 in which a developer is stored, a development container 140 to which the developer is supplied from the developer reservoir 150, and a tubing pump 220 connected between the development container 140 and the developer reservoir 150 via connection pipes 230*a* and 230*b*, to supply the developer to the development container 140 or to exhaust the developer from the development container 140.

A developer inlet/outlet 235 is formed on a lower portion of the development container 140, and the tubing pump 220 is connected to the developer inlet/outlet 235 through the connection pipes 230*a*. A rotor 211 is installed in the tubing pump 220 and supplies the developer to the development container 140 or exhausts the developer from the development container 140 in accordance with a rotational direction of the rotor 211.

A developer collecting portion 240 collecting the developer exceeding a predetermined level in the development container 140 through a collection path 241 is formed at one side of the development container 140, and the developer collected in the developer collecting portion 240 is returned to the developer reservoir 150 through a returning pipe 245.

Within the development container 140, there are provided a development roller 110 rotating opposite to a photosensitive drum 170 to supply the developer to the photosensitive drum 170, a metering blade 160 scratching the developer stained (deposited) on a circumference of the development roller 110 to a predetermined thickness, a depositing portion supplying a depositing voltage to attach the developer to a surface of the development roller 110, and a cleaning roller 130 cleaning the surface of the development roller 110.

The depositing portion includes a depositing roller 120 and a depositing power supply unit 121 supplying the depositing voltage to the depositing roller 120. The depositing roller 120 attaches the developer to the development roller 110 by an electric force of the depositing voltage supplied from the depositing power supply unit 121 and is soaked (immersed) in the developer contained in the development container 140. In this case, the depositing roller 120 may contact the development roller 110 or may be spaced apart from the development roller 110.

The cleaning roller 130 rotates to contact the development roller 110 and cleans the developer that is not used for developing a latent electrostatic image of the photosensitive drum 170 but left on the development roller 110.

In FIG. 2, a development power supply unit 111 supplies a development voltage to the development roller 110, and a transfer belt 200 transfers the image developed on the photosensitive drum 170 and prints the transferred image onto paper P of FIG. 3. In addition, a charging roller 180 charges the photosensitive drum 170, and a laser scanning unit 190 scans light on the photosensitive drum 170 to form the electrostatic latent image.

Only one developing system is provided in the image forming device using a single color, but as shown in FIG. 3, four developing systems are used in a color image forming device overlapping images corresponding a plurality of colors and printing the overlapped images on the paper P.

In the structure of the color image forming device of FIG. 3, in order to perform a development operation, as shown in FIG. 2, the rotor 211 installed in the tubing pump 220 rotates counterclockwise, thereby the developer is supplied to the development container 140 from the developer reservoir 150 through the developer inlet/outlet 235. In this case, the developer supplied to the development container 140 from the developer reservoir 150 is a high-concentration developer of greater than 3% solid particles. Subsequently, the developer exceeds a proper level of the development container 140 after a predetermined amount of the developer is supplied to the development container 140, and then an excessive amount of the developer is collected to a storing member 242 through a collection path 241. Thus, with this structure, the developer in the development container 140 is maintained at the proper level. The supplying and collecting of the developer is performed consecutively even during the development operation.

If the developer is supplied to the development container 140, the development operation starts. First, the depositing and developing voltages are supplied to the development roller 110 and to the depositing roller 120, respectively. If the the development and depositing voltages are supplied to the development roller 110 and to the depositing roller 120, respectively, toner particles attach to a surface of the development roller 110 by a voltage difference between the development roller 110 and the depositing roller 120. In this case, since a concentration difference of the developer is large, in a case that an electrostatic latent image formed on the photosensitive drum 170 is developed without change, it is difficult to develop an image with a uniform concentration.

Afterwards, the developer stained on the development roller 110 is regulated by a metering blade 160 to a predetermined and uniform thickness. As a result, even though the developer with a wider concentration range is used, the concentration of the developer before the development operation is maintained uniform, and thus the developer having a uniform thickness can be used in the development operation.

Subsequently, the electrostatic latent image formed on the photosensitive drum 170 is developed using the development roller 110 on which the developer with a uniform concentration is stained. After that, the developer left on the development roller 110 after the development operation is removed using the cleaning roller 130 soaked in the development container 140.

The developed image is transferred onto the transfer belt 200, and if the developed image is formed of only one color, the developed image is printed directly onto the paper P. However, in a case of implementing a color image, each image developed by each developing system for four colors, such as yellow (Y), cyan (C), magenta (M), and black (K), is formed on the transfer belt 200 to be overlapped with other images, and then is printed onto the paper P. Then, the paper P passes through a fusing unit 300, is heated, impressed (fixed), and exhausted.

In a case that the developing system is not used for a longer time or is repaired, as shown in FIG. 2, the rotor 211 in the tubing pump 220 rotates clockwise, thereby the developer in the development container 140 is exhausted through the developer inlet/outlet 235, and the exhausted developer is stored in the developer reservoir 150.

As described above, the developing system of a liquid electrophotographic image forming device according to the present invention can be simplified by performing operations of supplying and exhausting the developer using one tubing pump, and an additional developer exhausting unit is not required, and thus a manufacturing cost can be reduced. In addition, a compact structure of the image forming device can be achieved by simplifying the developer supplying and exhausting unit and the developer collecting unit.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A developing system of a liquid electrophotographic image forming device having a photosensitive drum, comprising:

a developer reservoir in which a developer is stored;

a development container in which the developer is supplied from the developer reservoir;

a development roller rotating opposite to the photosensitive drum in the development container to supply the developer from the development container to the photosensitive drum; and a pumping portion connected between the development container and the developer reservoir via a connection pipe to supply the developer to the development container from the developer reservoir and exhaust the developer from the development container and return the developer to the developer reservoir.

2. The system of claim 1, wherein the pumping portion comprises:

a tubing pump having a rotor installed in the pumping pump and selectively supplying and exhausting the developer through the connection pipe according to a rotational direction of the rotor.

3. The system of claim 1, wherein the development container comprises:

a developer inlet/outlet formed on a lower portion of the development container and connected to the pumping portion via the connection pipe.

4. The system of claim 3, wherein the pumping portion comprises:

a tubing pump having a rotor installed in the tubing pump and selectively supplying and exhausting the developer through the connection pipe according to a rotational direction of the rotor.

5. The system of claim 1, the pumping portion comprises:

a developer collecting unit collecting the developer exceeding a predetermined level in the development container and returning the developer to the developer reservoir.

6. A developing system in a liquid electrophotographic image forming device, comprising:

a developer reservoir containing a developer;

a development container containing the developer;

a photosensitive drum having a latent electrostatic image;

a development roller disposed in the developer container to transfer the developer from the development container to the photosensitive drum to develop the latent electrostatic image; and a connecting unit connected between the development container and the developer reservoir to supply the developer to the development container from the developer reservoir and exhaust the developer from the development container to the developer reservoir.

7. The system of claim 6, wherein the connecting unit comprises a returning pipe connected between the developer reservoir and the development container to allow an excessive amount of the developer contained in the development container to be exhausted from the development container to the developer reservoir.

8. The system of claim 7, wherein the development container comprises a portion between a bottom portion and a top portion of the development roller immersed in the developer contained in the development container, and the return pipe is connected to the portion of the development container.

9. The system of claim 6, wherein the connecting unit comprises a developer collecting portion mounted on the development container to communicate with the development container and the developer reservoir, and the developer collection portion comprises a storing member receiving an excessive developer flowing from the development container, storing the excessive developer, and allowing the stored excessive developer to be exhausted to the developer reservoir.

10. The system of claim 9, wherein the storing member comprises:

a collecting path formed between the development container and the storing member to allow the excessive developer to flow from the development container to the storing member; and a returning pipe coupled between the storing member and the developer reservoir to allow the received developer to be exhausted to the developer reservoir.

11. The system of claim 10, wherein the storing member comprises a lower portion lower than the collecting path, and the returning pipe is coupled to the lower portion of the storing member.

12. The system of claim 10, wherein the development container comprises a side portion, and the collecting path is formed on the side portion of the development container so that the excessive developer flows from the development container to the storing member through the collecting path.

13. The system of claim 10, wherein the development container comprises a portion higher than a bottom of the development roller which is immersed in the developer contained in the development container, and the collection path is disposed on the portion of the development container.

14. The system of claim 9, wherein the connecting unit comprises a pump pumping the developer from the development container to the developer reservoir and from the developer reservoir to the development container.

15. The system of claim 6, wherein the connecting unit comprises an inlet/outlet formed on a lower portion of the development container and a connection pipe coupled between the inlet/outlet and the developer reservoir to allow the developer to be supplied from the developer reservoir to the development container and to be exhausted from the development container to the developer reservoir.

16. The system of claim 6, wherein the connecting unit comprises a pump coupled between the development container and the developer reservoir and having a rotor, and the pump supplies the developer from the developer reservoir to the development container when the rotor rotates in a first direction and exhausts the developer from the development container to the developer reservoir when the rotor rotates in a second direction.

17. The system of claim 14, wherein the pump is disposed on a position lower than the development container.

18. The system of claim 6, wherein the liquid electrophotographic image forming device comprises a plurality of developing units each having the developer reservoir, the development container, the photosensitive drum, and the development roller, and the developing system comprises a plurality of connecting units each connected between the developer reservoir and the corresponding development container.

19. The system of claim 18, wherein the developing units comprises yellow (Y), cyan (C), magenta (M), and black (B) developing units.

20. The system of claim 18, wherein each connecting unit comprises a pump pumping the developer from the developer reservoir to the development container and from the development container to the developer reservoir.

21. The system of claim 20, wherein each pump operates depending on respective level of the developer contained in the corresponding development container.

22. The system of claim 20, wherein each pump operates at a give time.

23. A developing system in a liquid electrophotographic image forming device, comprising:

a developer reservoir containing a developer;

a development container containing the developer;

a photosensitive drum having a latent electrostatic image;

a development roller disposed in the development container, having a portion immersed in the developer contained in the development container, and transferring the developer from the development container to the photosensitive drum to develop the latent electrostatic image;

a developer collecting portion coupled between the development container and the developer reservoir to allow an excessive amount of the developer of the development container to be returned to the developer reservoir from the development container by a weight of the developer; and a pump having a rotor and being coupled between the developer and the development container to pump the developer from the development container to the developer reservoir and from the developer reservoir to the development container according to a rotational direction of the rotor of the pump.

24. The system of claim 23, wherein the development container comprises a portion disposed between a top and a bottom of the development roller, and the developer collecting portion is connected to the portion of the development container.

* * * * *